US010478838B2

(12) United States Patent
Lin et al.

(10) Patent No.: US 10,478,838 B2
(45) Date of Patent: Nov. 19, 2019

(54) CENTRIFUGAL WATER SPRAY STRUCTURE AND SHOWERHEAD INCLUDING THE SAME

(71) Applicant: FUJIAN XIHE SANITARY WARE TECHNOLOGY CO., LTD., Nan'an (CN)

(72) Inventors: Xiaofa Lin, Nan'an (CN); Xiaoshan Lin, Nan'an (CN); Zhigang Wan, Nan'an (CN); Qiqiao Liu, Nan'an (CN); Xiaoqing Deng, Nan'an (CN)

(73) Assignee: FUJIAN XIHE SANITARY WARE TECHNOLOGY., LTD., Nan'an, Fujian Province (CN)

( * ) Notice: Subject to any disclaimer, the term of this patent is extended or adjusted under 35 U.S.C. 154(b) by 2 days.

(21) Appl. No.: 15/871,453

(22) Filed: Jan. 15, 2018

(65) Prior Publication Data

US 2018/0297042 A1 Oct. 18, 2018

(30) Foreign Application Priority Data

Apr. 17, 2017 (CN) ..... 2017 2 0399478 U

(51) Int. Cl.
*B05B 1/18* (2006.01)
*B05B 1/30* (2006.01)
(Continued)

(52) U.S. Cl.
CPC ..... *B05B 1/185* (2013.01); *B05B 1/3006* (2013.01); *B05B 1/3457* (2013.01); *B05B 12/002* (2013.01); *B05B 12/08* (2013.01)

(58) Field of Classification Search
CPC ..... B05B 1/18; B05B 1/185; B05B 3/0463; B05B 15/18
See application file for complete search history.

(56) References Cited

U.S. PATENT DOCUMENTS 4,989,786 A * 2/1991 Kranzle ..... B05B 3/0463 239/240
5,395,053 A * 3/1995 Frech ..... B05B 3/0463 239/227

(Continued)

FOREIGN PATENT DOCUMENTS

JP 2004105791 A * 4/2004 ..... B05B 3/0463
WO 2014/023341 A1 2/2014

OTHER PUBLICATIONS

GB Search and Examination Report dated Jun. 27, 2018, Application No. GB18004853, Applicant Fujian Xihe Sanitary Ware Technology Co Ltd, 4 Pages.

*Primary Examiner* — Darren W Gorman
(74) *Attorney, Agent, or Firm* — Brooks Kushman P.C.

(57) ABSTRACT

A centrifugal water spray structure is provided. The centrifugal water spray structure includes: a chamber having a chamber axis and an opening, a water jetting device for jetting water into the chamber in a direction not parallel to the chamber axis, thereby creating a vortex flow in the chamber, and a rotary plug received in the chamber. One end of the rotary plug abuts an edge of the opening of the chamber in a manner that sealing is formed between the rotary plug and the edge of the opening, and the other end of the rotary plug is a free end so that the rotary plug is able to be driven to rotate about the chamber axis by the vortex flow. A plug water passage is formed inside the rotary plug. Further, a showerhead using the centrifugal water spray structure is provided.

14 Claims, 6 Drawing Sheets

(51) Int. Cl.

| | |
|---|---|
| ***B05B 1/34*** | (2006.01) |
| ***B05B 12/00*** | (2018.01) |
| *B05B 12/08* | (2006.01) |

(56) References Cited

U.S. PATENT DOCUMENTS

| | | | | |
|---|---|---|---|---|
| 5,598,975 | A * | 2/1997 | Jager | B05B 3/0463 239/237 |
| 6,029,906 | A * | 2/2000 | Binder | B05B 3/0463 239/237 |
| 6,155,494 | A * | 12/2000 | Fabbri | B05B 3/0427 239/240 |
| 6,230,984 | B1 * | 5/2001 | Jager | B05B 1/14 239/225.1 |
| 7,997,512 | B2 * | 8/2011 | Jaeger | B05B 3/0463 239/225.1 |
| 2004/0019962 | A1 | 2/2004 | Sato et al. | |
| 2006/0261183 | A1 * | 11/2006 | Wimmer | B05B 3/0463 239/225.1 |
| 2010/0282864 | A1 | 11/2010 | Jaeger | |
| 2012/0138706 | A1 | 6/2012 | Wesch et al. | |
| 2016/0228888 | A1 | 8/2016 | Ferrarini | |
| 2016/0318045 | A1 | 11/2016 | Huffington et al. | |

* cited by examiner

CENTRIFUGAL WATER SPRAY STRUCTURE AND SHOWERHEAD INCLUDING THE SAME

CROSS-REFERENCE TO RELATED APPLICATIONS

The present disclosure claims priority to Chinese Patent Application No. 201720399478.5, filed on Apr. 17, 2017, the entire specification of which is hereby incorporated by reference in its entirety for all purposes.

TECHNICAL FIELD

This application relates to the technical field of sanitary ware, and in particular, to a centrifugal water spray structure and a showerhead including the same.

BACKGROUND

There is a need for novel water spraying patterns to enrich consumers' choices and increase joy during a shower.

In the conventional showerhead structure, the way of changing the water spraying pattern is mainly realized by changing the water pressure or the water outlet angle at the showerhead nozzle via gear meshing. However, complicated structures such as gear meshing will not only increase the manufacturing cost of the showerhead but also may cause the failure of the transmission mechanism due to wear or the like during frequent or long-term use, thereby deteriorating the water spraying performance of the showerhead and affecting the user's shower experience.

SUMMARY

The following is a summary of the subject matter described herein in details. This summary is not intended to limit the protection scope of the claims.

The present disclosure provides a centrifugal water spray structure and a showerhead having simple structures, high reliability, and unique spraying patterns.

In order to achieve the above object, this application adopts the following technical schemes:

A centrifugal water spray structure comprises a chamber having a chamber axis and provided with an opening; a water jetting device for jetting water into the chamber in a direction not parallel to the chamber axis, thereby creating a vortex flow in the chamber; and a rotary plug received in the chamber. One end of the rotary plug abuts an edge of the opening of the chamber in a manner that sealing is formed between the rotary plug and the edge of the opening, and the other end of the rotary plug is a free end so that the rotary plug is able to be driven to rotate about the chamber axis by the vortex flow in the chamber. A plug water passage is formed inside the rotary plug, with one end of the plug water passage communicating with the interior of the chamber and the other end of the plug water passage located at the opening and communicating with the exterior of the chamber.

A showerhead comprising at least one centrifugal water spray structure described herein.

BRIEF DESCRIPTION OF THE DRAWINGS

The drawings described herein are used to provide further understanding of embodiments according to the present disclosure and form a part of the present disclosure. The exemplary embodiments of the present disclosure and the description thereof are used to explain the present disclosure and do not constitute limitation to this application.

DETAILED DESCRIPTION

Figure 1:
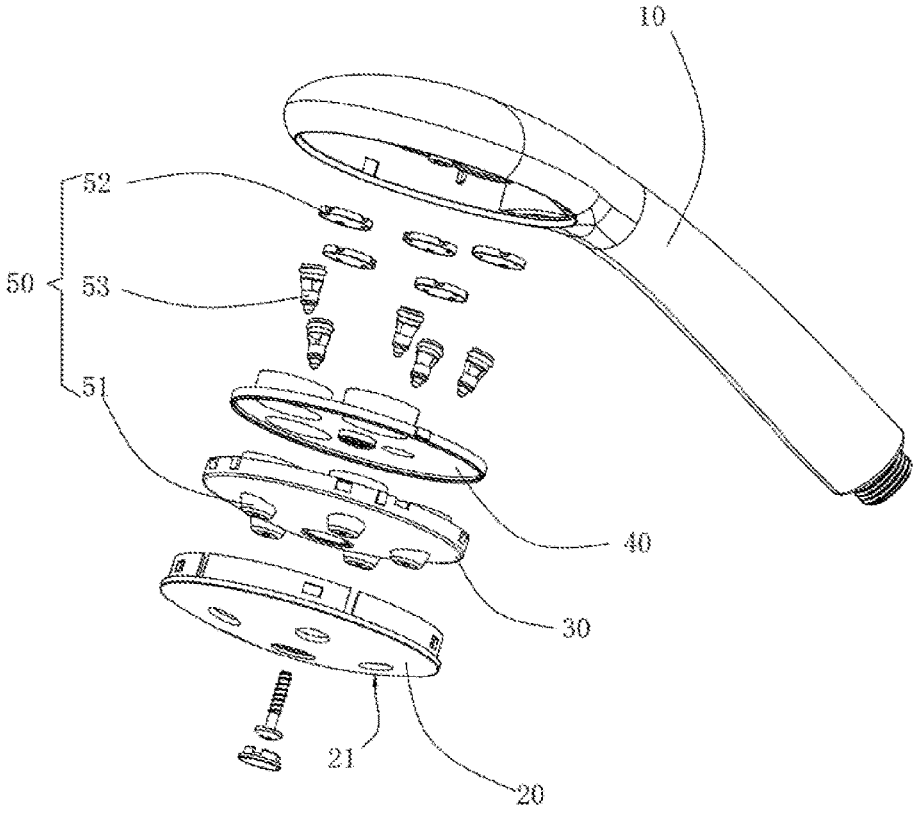
FIG. 1 is a schematic view of the breakdown structure of a showerhead according to an embodiment of the present disclosure.

In order to make the technical schemes and advantageous effects of the present disclosure clearer, the present disclosure is further expounded with embodiments in combination with the drawings in the following. It should be appreciated that the specific embodiments described herein are only used for explaining the present disclosure but are not used for limiting the present disclosure.

The present disclosure discloses a centrifugal water spray structure for generating a unique water spraying pattern that can be used in showerheads to provide good shower experience for users. Such unique spray pattern is primarily generated by a rotary plug having an internal water passage that is driven to rotate by a vortex flow in a chamber.

According to multiple embodiments of the present disclosure, a centrifugal water spray structure 50 includes a chamber 512 having a chamber axis A1 and an opening 511, and a water jetting device 52 for jetting water into the chamber. The water jetting device 52 jets water into the chamber 512 in a direction not parallel to the chamber axis A1, thereby generating a vortex flow in the chamber. At least one water jetting hole 521 in communication with the chamber 512 may be disposed in the water jetting device 52 and the water outlet direction of the at least one water jetting hole 521 is arranged to be tangent to an imaginary circle centered on the chamber axis A1. The flow direction of water flow jetted from the water jetting hole is tangent to the imaginary circle so that the jetted water flow rotates in the chamber 512 to form a vortex flow.

According to the embodiments shown in FIGS. 1-5, the chamber 512 of the centrifugal water spray structure 50 is formed in a water outlet seat 51. Specifically, the water outlet seat 51 is provided with an opening 511, and a chamber 512 having a chamber axis A1 is formed in the interior thereof. According to multiple embodiments of the present disclosure, the width of the opening 511 is 2-3 mm.

Preferably, for example, in the example as shown in the figures, the chamber 512 is substantially frustum cone-shaped with a minimum cross-sectional area at the opening 511. According to multiple embodiments, the frustum cone-shaped chamber 512 has a taper angle of 30-40 degrees. It should be understood that a chamber in other shapes, e.g., a cylindrical chamber, can be envisaged according to actual needs.

The water jetting device 52 may be a water jetting plate that may be used to enclose the chamber 512. According to the embodiments shown in FIGS. 1-5, the water jetting plate 52 is covered on the side of the water outlet seat 51 forming the chamber 512 that is opposite the opening 511, and may form sealing between the contact portion of the water jetting plate 52 with the water outlet seat 51. Optionally, the water outlet seat 51 is provided with a supporting shoulder 513 near the water inlet side thereof for securing the water jetting device 52.

Specifically, according to multiple embodiments, each water jetting hole 521 includes a recessed pool 522 and an inclined water hole 523 that are disposed sequentially along a water flowing direction. The recessed pool 522 is disposed on a side of the water jetting plate 52 facing away from the chamber 512, and the inclined water hole 523 is disposed on a side of the water jetting device 52 facing the chamber 512. Moreover, the inclined water hole 523 is arranged to be inclined with respect to the chamber axis A1 of the chamber 512, and the water outlet direction of the inclined water hole 523 is arranged to be tangent to the imaginary circle centered on the chamber axis A1.

The centrifugal water spray structure 50 further includes a rotary plug 53 received in the chamber 512. One end of the rotary plug 53 abuts the edge of the opening 511 and sealing is formed between the edge of the opening 511 and the rotary plug 53. The other end of the rotary plug 53 is a free end so that the rotary plug 53 can be driven to rotate about the chamber axis A1 by the vortex flow in the chamber 512. When rotating, the rotary plug 53 may be or may not be in contact with the inner surface of the chamber 512.

The rotary plug 53 has a plug axis A2 extending in the longitudinal direction thereof. The plug axis A2 is inclined with respect to the chamber axis A1 of the chamber 512 when the rotary plug 53 is driven by the vortex flow in the chamber 512.

A plug water passage 531 is formed inside the rotary plug 53 and one end of the plug water passage 531 communicates with the interior of the chamber 512 and the other end of the plug water passage 531 is located at the opening 511 and communicates with the exterior of the chamber 512.

When the water jetting device 52 jets water into the chamber 512 in a direction not parallel to the chamber axis A1, the generated vortex flow drives the rotary plug 53 to rotate about the chamber axis A1, in the meantime the rotary plug 53 abuts and seals the edge of the opening 511 of the chamber 512 at one end. The water flowing into the chamber 512 from the water jetting device 52 is jetted out via the plug water passage 531. Since the plug water passage 531 (particularly, the water outlet port thereof) rotates in a direction inclined with respect to the chamber axis A1 along with the rotary plug 53, under the double action of the direction of the water outlet port and the centrifugal force, the water flowing out of the water outlet port of the rotary plug 53 forms a conical shape, thereby achieving the unique water spraying pattern of the present disclosure. According to multiple embodiments of the present disclosure, the water is jetted at an angle of 135-145 degrees.

Figure 4:
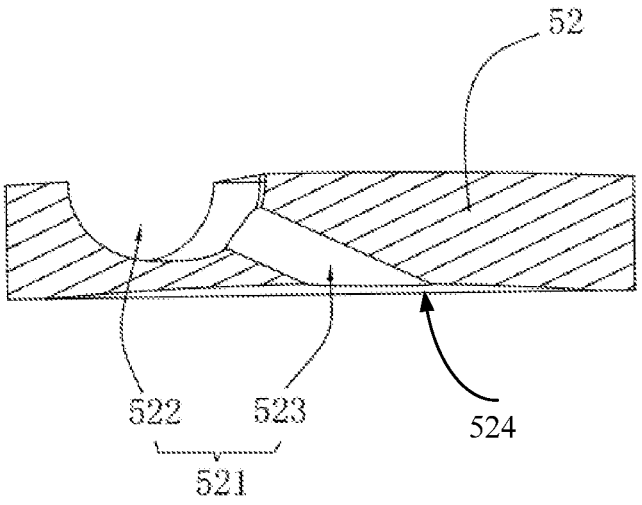
FIG. 4 is a schematic view of the structure of a water jetting plate in the centrifugal water spray structure shown in FIG. 3.
Figure 5:
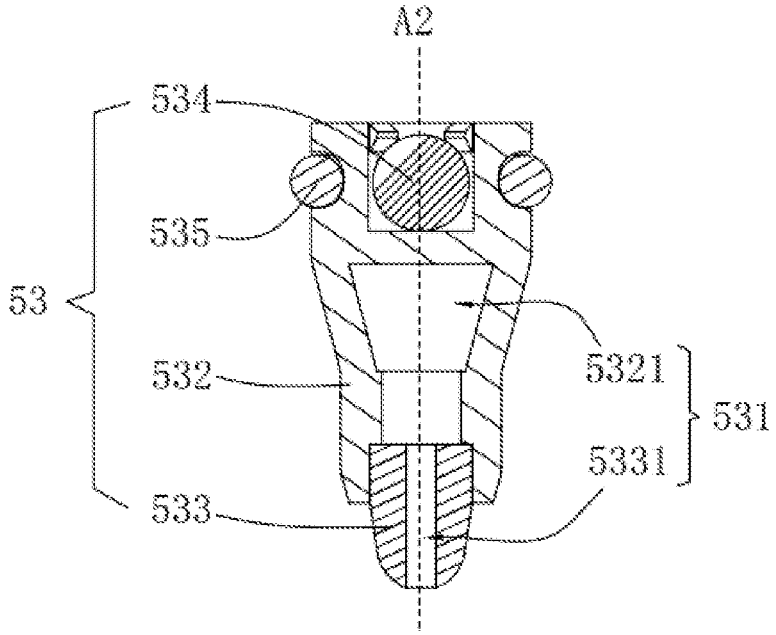
FIG. 5 is a schematic view of the structure of a rotary plug in the centrifugal water spray structure shown in FIG. 3.

Since the rotary plug 53 is rotationally moved in the chamber 512 under the action of the water flow, in order not to affect the rotational movement of the rotary plug 53 while making the overall structure more compact, the inner surface of the chamber 512 located at the end opposite the opening 511 has a concave dome structure 524, as shown in FIG. 4.

In the embodiments shown in FIGS. 1-5, the rotary plug 53 includes a plug body 532 and a rotary head 533 connected to one end of the plug body 532. The plug body 532 and the rotary head 533 are coaxially disposed, and the rotary head 533 abuts and seals the edge of the opening 511 of the chamber. Optionally, the rotary head 533 is embedded in one end of the plug body 532.

A plug body water passage 5321 is formed in the plug body 532, and a rotary head water passage 5331 is formed in the rotary head 533. The plug body water passage 5321 and the rotary head water passage 5331 communicate with each other, together forming the plug water passage 531, wherein the water inlet end of the plug body water passage 5321 communicates with the chamber 512, and the water outlet end of the rotary head water passage 5331 communicates with the exterior of the chamber 512 via the opening 511.

Figure 6:
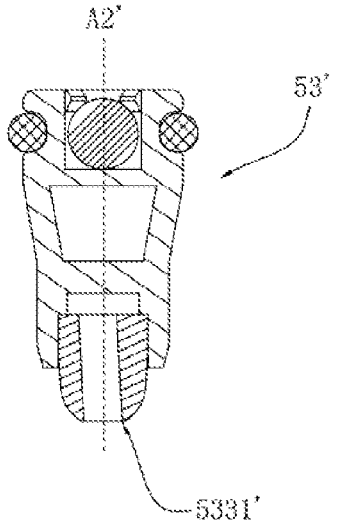
FIG. 6 is a schematic view of the structure of another embodiment of a rotary plug.

In the embodiments shown in FIGS. 1-5, the rotary head water passage 5331 is disposed parallel to the plug axis A2 of the rotary plug 53. Optionally, as shown in FIG. 6, in another embodiment, the rotary head water passage 5331' may also be disposed to intersect with the plug axis A2' of the rotary plug 53'.

Figure 10:
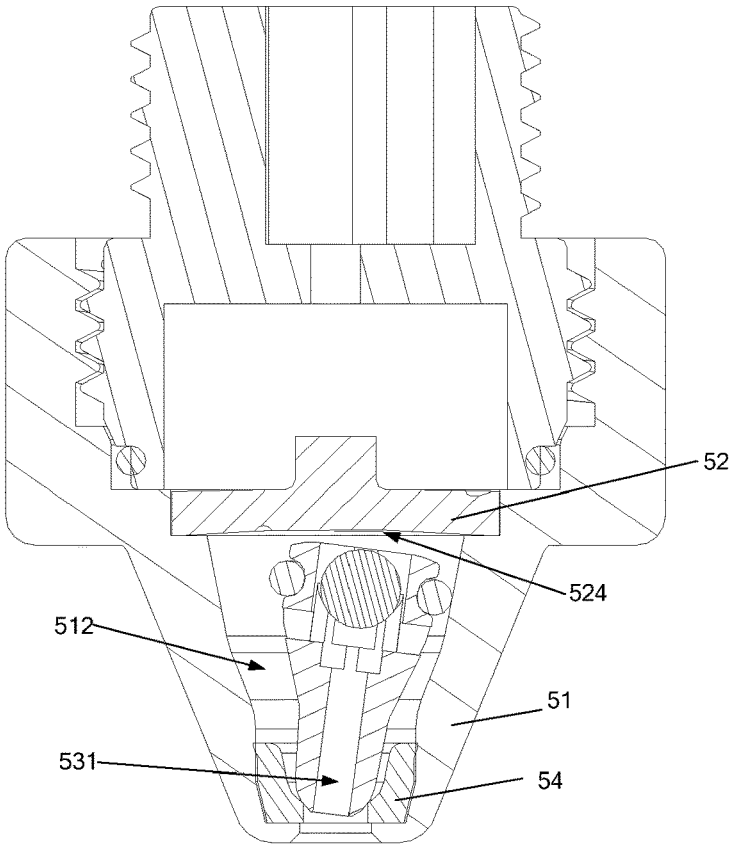
FIG. 10 is a schematic view of the structure of a centrifugal water spray structure according to yet another embodiment of the present disclosure.
Figure 11:
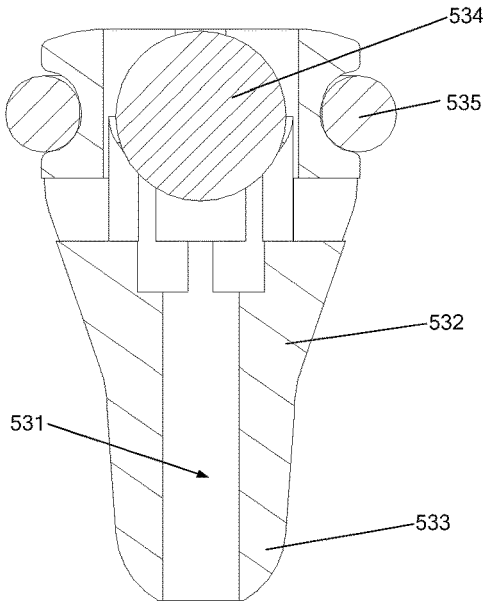
FIG. 11 is a schematic view of the structure of a rotary plug of the centrifugal water spray structure in FIG. 10.

Alternatively, in some embodiments, as shown in FIG. 10 and FIG. 11, the plug body 532 and the rotary head 533 are of a unitary structure, so as to reduce the overall height of the rotary plug 53 and thus reduce the overall height of the centrifugal water spray structure, ultimately enabling a smaller overall size of the showerhead using the centrifugal water spray structure.

The rotary plug 53 may further include an O-ring 535 sleeved on the plug body 532 for providing a contact portion of the rotary plug 53 with the inner surface of the chamber 512. Optionally, the O-ring 535 is sleeved on the outer side of the end of the plug body 532 away from the rotary head 533.

Optionally, the rotary plug 53 may further include a weighting mass 534. Preferably, the weighting mass 534 is embedded in the end of the plug body 532 away from the opening 511 of the chamber 512. In the example shown in the figures, the weighting mass 534 is ball-shaped, and preferably, the ball-shaped weighting mass 534 is rotatable with respect to the remains of the rotary plug 53. It should be understood that weighting mass in other shapes can be envisaged. Optionally, at least a portion of the weighting mass 534 may be disposed in a mounting hole located at the end of the rotary plug 53 away from the opening 511. Alternatively, at least a portion of the weighting mass 534 may be disposed within the plug body water passage 5321.

Figure 7:
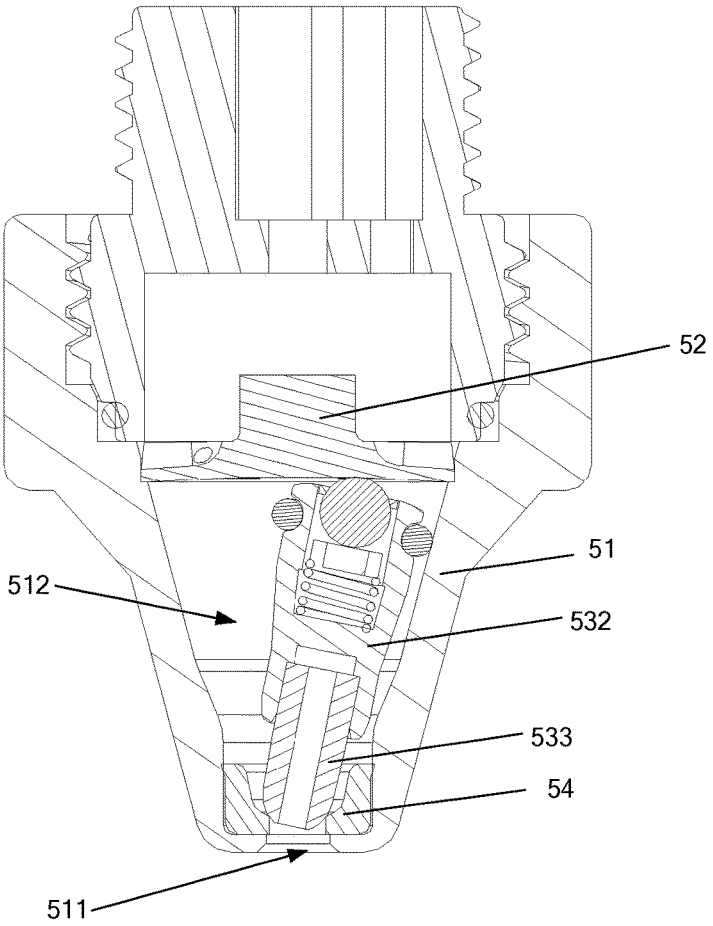
FIG. 7 is a schematic view of the structure of a centrifugal water spray structure according to another embodiment of the present disclosure.

Optionally, as in the embodiment shown in FIG. 7, the rotary plug 53 may further include an elastic member 536 that forces a portion of the rotary plug 53 to abut the inner surface of the chamber 512 located at an end opposite the opening 511.

Figure 8:
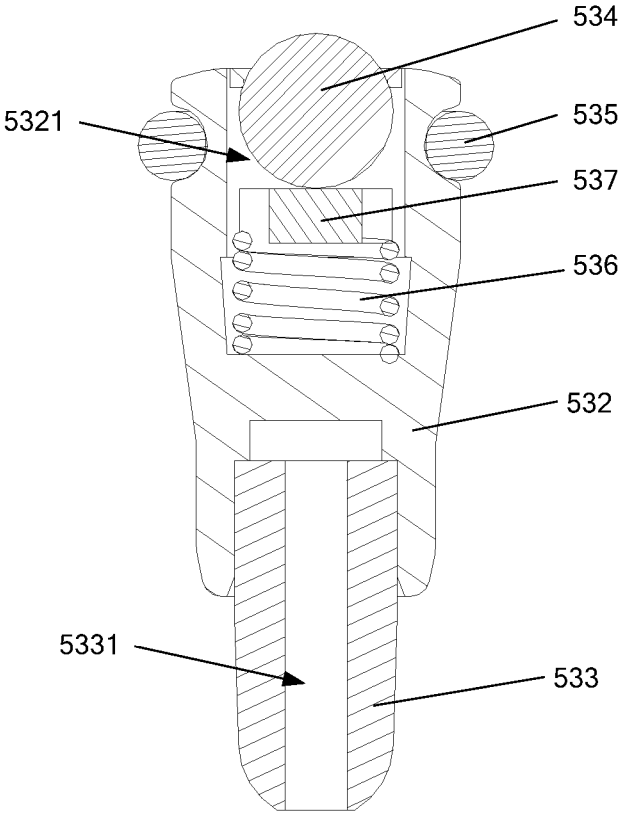
FIG. 8 is a schematic view of the structure of a rotary plug of the centrifugal water spray structure in FIG. 7.

Optionally, the elastic member 536 makes the weighting mass 534 abut the inner surface of the chamber 512 located at the end opposite the opening 511. As shown in FIG. 7 and FIG. 8, an elastic member 536 is disposed between the weighting mass 534 and the end of the plug body 532 away from the rotary head 533. The elastic member 536 can be a spring (or other structure made of an elastic material, e.g., an elastic pad or the like). When the assembly of centrifugal water spray structure 50 is completed, the spring 536 is in a compressed state and the weighting mass 534 abuts the inner surface of the end of the chamber 512 opposite the opening 511 under the elastic force of the spring 536.

Optionally, in the embodiment shown in FIG. 7, at the opening of the chamber 512 is provided a wear-resistant member 54 made of a wear-resistant material. The wear-resistant member 54 is provided with a hole, and the rotary plug 53 abuts the edge of the hole. The arrangement of the wear-resistant member 54 avoids the direct contact of the rotary plug 53 with the water outlet seat 51, thereby avoiding the wear of the water outlet seat 51 when the rotary plug 53 rotates. Therefore, the water outlet seat 51 does not need to be made of a wear-resistant material, so that the material selection range of the water outlet seat 51 is wider, which is favorable for selecting a material meeting the requirements, having a low cost, easy to process etc. to reduce the production cost of the water outlet seat 51.

According to the embodiment shown in FIG. 7, the weighting mass 534 abuts the inner surface of the end of the chamber 512 opposite the opening 511 all the time under the action of the elastic force of the spring 536, and the rotary head 533 abuts and seals the edge of the hole of the wear-resistant member 54 all the time (or abuts the chamber 512 and seals the edge of the opening 511 in the absence of the wear-resistant member) so that the water remaining in the chamber 512 will not pass through the opening 511 and finally escapes from showerhead, to avoid water leakage and dripping after the showerhead stops spraying water.

Figure 9:
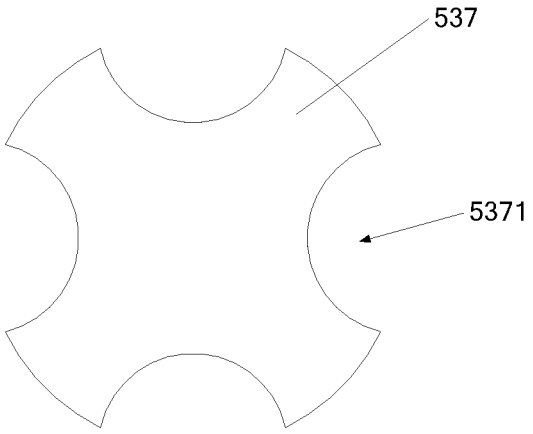
FIG. 9 is a schematic view of the structure of a water-passing gasket of the rotary plug in FIG. 8.

Further, in the embodiment shown in FIGS. 7-8, the water inlet port of the plug body water passage 5321 is provided at the end of the plug body 532 away from the rotary head 533. A portion of the weighting mass 534 and the spring 536 may be disposed in the plug body water passage 5321, and a water-passing gasket 537 is disposed between the weighting mass 534 and the spring 536. A water-passing hole 5371 (see FIG. 9) is provided on the water-passing gasket 537 to ensure that water entering one end of the plug body water passage 5321 can flow through the gap between the weighting mass 534 and the chamber 512 and enter the rotary head water passage 5331 after flowing through the water-passing hole 5371 and the spring 536. In addition, the end face of the water-passing gasket 537 may support the weighting mass 534 to facilitate rotation of the weighting mass 534 such that rolling friction is between the weighting mass 534 and the inner surface of the end of the chamber 512 opposite the opening 511 in order to reduce the magnitude of the friction force, increasing the rotation speed of the rotary plug 53.

Of course, a portion of the weighting mass 534 and/or the spring 536 may not be disposed in one end of the plug body water passage 5321, but a mounting hole (not shown) may be additionally provided at the end of the plug body 532 away from the rotary head 533, and a portion of the weighting mass 534 and the spring 536 are disposed in the mounting hole.

Figure 2:
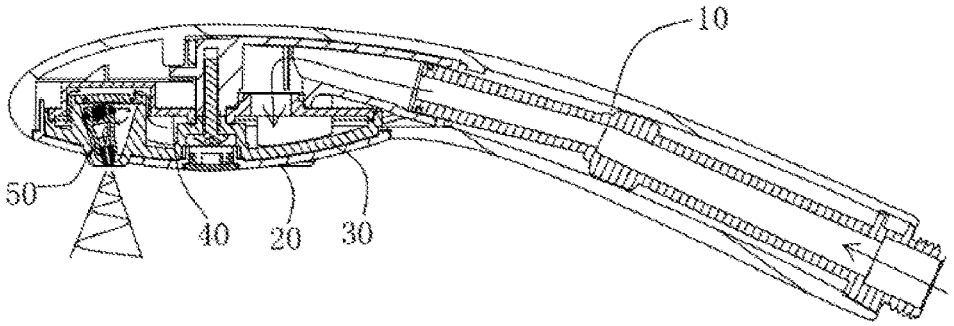
FIG. 2 is a cross-sectional view of the showerhead shown in FIG. 1.
Figure 3:
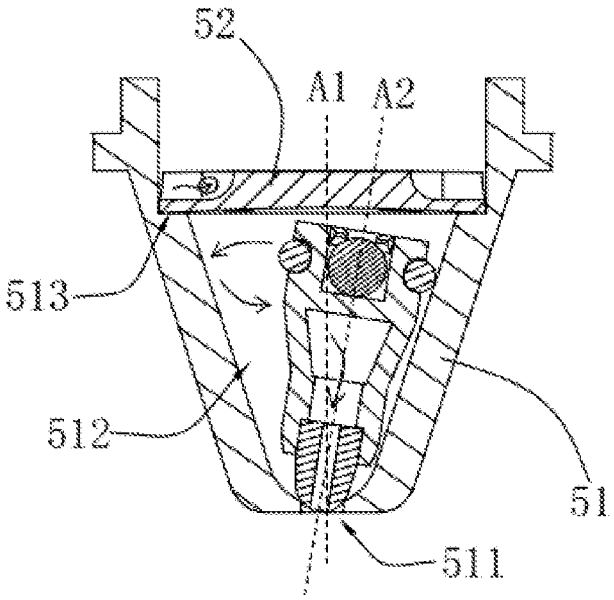
FIG. 3 is a schematic view of the structure of a centrifugal water spray structure shown in FIG. 1.

FIGS. 1 and 2 schematically show a showerhead to which the centrifugal water spray structure 50 described above is applied. According to multiple embodiments, the showerhead includes a showerhead body 10, and further includes a panel cover 20, a water outlet panel 30, a water dispensing disc 40 and at least one centrifugal water spray structure 50 that are sequentially fixed to the showerhead body 10 from outside to inside. Each centrifugal water spray structure 50 is fixed to the water outlet panel 30. For each centrifugal water spray structure 50 the panel cover 20 is provided with an aperture 21.

In the present embodiment, the relationship between the centrifugal water spray structures 50 and the water dispensing disc 40 is that a water inlet of the water outlet seat 51 of each centrifugal water spray structure 50 is provided toward the opening of the water dispensing disc 40, so that the water dispensing disc 40 dispenses water to the water inlet side of the water outlet seat 51.

The relationship between the centrifugal water spray structure 50 and the water outlet panel 30 is that the water outlet seat 51 of the centrifugal water spray structure 50 is fixed to the water outlet panel 30. In particular, the water outlet seat 51 and the water outlet panel 30 may be separate structures or may be an integrally formed structure. In addition, the water outlet end of the water outlet seat 51 is configured to protrude out of the water outlet panel 30.

The relationship between the centrifugal water spray structure 50 and the panel cover 20 is that the outlet end of the water outlet seat 51 of each centrifugal water spray structure 50 passes through an aperture 21 of the panel cover 20 and extends out of the panel cover 20, thereby the opening 511 extends out of the panel cover 20, spraying water from the showerhead.

When the showerhead is used, water enters the water dispensing disc 40 from the interior of the showerhead body 10 and is dispensed to each centrifugal water spray structure 50 through the water dispensing disc 40.

According to the embodiment in FIGS. 1-2, the water enters the chamber 512 in the water outlet seat 51 from the water jetting plate 52 of the centrifugal water spray structure 50. Since the water outlet direction of the water jetting hole 521 in the water jetting plate 52 is arranged to be tangent to an imaginary circle centered on the chamber axis A1 of the chamber 512, water forms swirling water flowing along the surface of the chamber 512 after jetted through the water jetting hole 521, so as to push the rotary plug 53 to rotate about the chamber axis A1 along the inner surface of the chamber 512.

At the same time, water flow in the chamber 512 jets out via the plug water passage 531, wherein the water jetting angle may be 135-145 degrees.

It should be noted that rotating water of the showerhead is formed by the individual rotation of the centrifugal water spray structure 50, and its structure is simple and the effect of the rotating water is realized without the need of conversion through complex structures such as impellers, gears and the like. When the showerhead is used, a stream of jetted water revolving around the opening 511 can be clearly seen in a low pressure state. If the water pressure increases, the rotary plug 53 rotates faster, and under the action of the centrifugal force, the water stream rapidly spins to form a circle that forms a large circle around the center of the opening 511. Because the jetted water is spinning, a very strong sense of massage can be felt. The jetted water has revolution effect while spinning under the effect of the centrifugal force, thereby generating a very shocking water pattern with an excellent visual impact effect and actual experience, as well as a very strong effect of massage.

During the flow test, the jetting distance of the jetted water of the showerhead under different water pressure conditions was measured. Comparing the showerhead provided by the embodiments of the present disclosure with the conventional showerhead with a complicated structure such as impeller and gear in terms of the flow test data, the jetted water provided by the showerhead provided by the embodiments of the present disclosure is recorded as a new sprayed water, and the jetted water provided by the conventional showerhead with a complicated structure such as impellers, gears and the like is recorded as a conventional sprayed water, the specific comparison results are shown in the table below:

| Water pressure (MPa) | New sprayed water (m) | Conventional sprayed water (m) |
|---|---|---|
| 0.1 | 4 | 2.5 |
| 0.2 | 6.5 | 4.5 |
| 0.3 | 8.5 | 6 |

It will be apparent that, under the same pressure conditions, the jetted water of the showerhead provided by the embodiments of the present disclosure has a better jetting speed so as to provide a better shower experience effect and a stronger massage effect.

Compared with the prior art, the technical schemes in the embodiments of the present disclosure have the following beneficial effects:

1. In the centrifugal water spray structure, the rotary plug is driven to rotate about the chamber axis by the water jetted by the water jetting device, thereby the water flow in the chamber is jetted out through the plug water passage rotating together with the rotary plug. Therefore, the jetted water of the showerhead is spinning, generating a very strong effect of massage. The jetted water has revolution effect while spinning under the effect of the centrifugal force, thereby generating a very shocking water pattern with an excellent visual impact effect and actual experience, as well as a very strong effect of massage.

2. The water outlet direction of each water jetting hole of the water jetting device is arranged to be tangent to an imaginary circle centered on the chamber axis of the chamber, thereby enabling the water jetted by the water jetting device to form a turbo-type water flow along the inner surface of the chamber, so as to enhance the pushing effect of the rotary plug 53.

3. Each water jetting hole includes a recessed pool and an inclined water hole that are disposed sequentially along the water flowing direction and in communication with each other, and the arrangement of the recessed pool may allow an increased pressure of the water flow entering the inclined water hole, so as to further increase the speed of the water jetted out through the inclined water hole.

4. The weighting mass is provided at the end of the plug body away from the rotary head, so as to improve the stability of centrifugal motion of the rotary plug by means of the weighting mass.

5. The O-ring is sleeved on the end of the plug body away from the rotary head. On one hand, the O-ring can prevent a hard collision between the plug body and the inner wall of the chamber; on the other hand, it can also increase the friction between the plug body and the inner wall of the chamber, thereby reducing the rotational speed of the rotary plug.

6. The side of the water jetting device facing toward the rotary plug has a concave dome structure, so as to facilitate the rotation of the rotary plug.

7. The taper angle of the chamber is 30-40 degrees, the width of the opening is 2-3 mm, thereby the angle of the water jetted from the opening is 135-145 degrees, enabling a good water outlet effect of the showerhead and a strong effect of massage of the jetted water.

The above depiction has illustrated and described exemplary embodiments of the present disclosure, and as stated above, it should be appreciated that the present disclosure is not limited to the forms disclosed in this text, and it should not be regarded as exclusion of other embodiments but can be used in other combinations, modifications and environments, and can be varied according to the above teaching or the technology or knowledge in the related art within the conception range of the present disclosure. The modifications and changes made by a person skilled in the art, without departing from the spirit and scope of the present disclosure, should be within the protection scope of the appended claims of the present disclosure.

What is claimed is:

1. A centrifugal water spray structure comprising:

a chamber having a chamber axis and provided with an opening;

a water jetting plate for jetting water into the chamber in a direction not parallel to the chamber axis, thereby creating a vortex flow in the chamber; and a rotary plug received in the chamber;

wherein one end of the rotary plug abuts an edge of the opening of the chamber in a manner that sealing is formed between the rotary plug and the edge of the opening, and the other end of the rotary plug is a free end so that the rotary plug is able to be driven to rotate about the chamber axis by the vortex flow in the chamber, wherein a plug water passage is formed inside the rotary plug, with one end of the plug water passage communicating with the interior of the chamber and the other end of the plug water passage located at the opening and communicating with the exterior of the chamber, wherein the rotary plug comprises a weighting mass disposed at the end of the rotary plug away from the opening of the chamber, wherein the weighting mass comprises a weighting ball that is rotatable with respect to remains of the rotary plug, wherein the rotary plug comprises an elastic member which forces the weighting ball to abut an inner surface of the chamber located at an end opposite the opening, and wherein a water-passing gasket is provided between the weighting ball and the elastic member, and the water-passing gasket is provided with a water-passing hole.

2. The centrifugal water spray structure of claim 1, wherein at least one water jetting hole in communication with the chamber is disposed in the water jetting plate, and a water outlet direction of the at least one water jetting hole is arranged to be tangent to an imaginary circle centered on the chamber axis.

3. The centrifugal water spray structure of claim 1, wherein the water jetting plate is used for enclosing the chamber.

4. The centrifugal water spray structure of claim 3, wherein the water jetting plate comprises a recessed pool and an inclined water hole that are arranged in communication with each other, the recessed pool being disposed on a side of the water jetting plate facing away from the chamber, the inclined water hole being disposed on a side of the water jetting plate facing the chamber.

5. The centrifugal water spray structure of claim 1, wherein the chamber is substantially frustum cone-shaped with a minimum cross-sectional area at the opening.

6. The centrifugal water spray structure of claim 5, wherein a taper angle of the chamber is 30-40 degrees and a width of the opening is 2 to 3 mm, thereby water is jetted from the centrifugal water spray structure at an angle of 135-145 degrees.

7. The centrifugal water spray structure of claim 1, wherein the rotary plug comprises a plug body and a rotary head connected to one end of the plug body, and the plug body and the rotary head are coaxially disposed, and the rotary head abuts and seals the opening of the chamber;

wherein a plug body water passage is formed in the plug body, a rotary head water passage is formed in the rotary head, the rotary head water passage is arranged to extend parallel to a plug axis of the rotary plug or to extend intersecting with the plug axis; and wherein the plug body water passage and the rotary head water passage communicate with each other, forming the plug water passage together.

8. The centrifugal water spray structure of claim 7, wherein the rotary plug further comprises an O-ring sleeved on the plug body for providing a contact portion of the rotary plug with an inner surface of the chamber.

9. The centrifugal water spray structure of claim 1, wherein a wear-resistant member is provided at the opening of the chamber, the wear-resistant member is provided with a hole, and the rotary plug abuts an edge of the hole in the wear-resistant member.

10. The centrifugal water spray structure of claim 1, wherein:

a mounting hole is provided at the end of the rotary plug away from the opening, and at least a portion of the weighting mass is disposed in the mounting hole; or at least a portion of the weighting mass is disposed within the plug water passage.

11. The centrifugal water spray structure of claim 1, wherein an inner surface of the chamber located at the end opposite the opening has a concave dome structure.

12. A showerhead comprising at least one centrifugal water spray structure of claim 1.

13. The showerhead of claim 12, wherein the showerhead comprises a showerhead body, and the showerhead further comprises a panel cover, a water outlet panel and a water dispensing disc that are fixed to the showerhead body sequentially from outside to inside, wherein each centrifugal water spray structure is fixed to the water outlet panel.

14. The showerhead of claim 13, wherein for each centrifugal water spray structure the water dispensing disc is provided with a water dispensing hole for dispensing water to the centrifugal water spray structure; and for each centrifugal water spray structure the panel cover is provided with an aperture through which each centrifugal water spray structure passes and protrudes out of the panel cover.

* * * * *